United States Patent [19]

Barbieri et al.

[11] Patent Number: 4,899,324

[45] Date of Patent: Feb. 6, 1990

[54] CLOCK WITH PENDULAR ELEMENT

[76] Inventors: Raul Barbieri; Giorgio Marianelli, both of Via Faruffini, 13, 20149 Milan, Italy

[21] Appl. No.: 216,800

[22] Filed: Jul. 8, 1988

[30] Foreign Application Priority Data

Aug. 4, 1987 [IT] Italy ..... 22165/87[U]

[51] Int. Cl.[4] ..... G04B 19/00; G04B 19/06

[52] U.S. Cl. ..... 368/76; 368/223; 368/236

[58] Field of Search ..... 368/76, 80, 134, 165, 368/179, 223, 228–229

[56] References Cited

U.S. PATENT DOCUMENTS

| | | | |
|---|---|---|---|
| 1,074,130 | 9/1913 | Miller | 368/236 |
| 2,051,611 | 8/1936 | Liner | 368/77 |
| 3,665,700 | 5/1972 | Ditello et al. | 368/179 |
| 3,747,330 | 7/1973 | Tupone | 368/229 |
| 3,934,405 | 1/1976 | Baker | 368/233 |

FOREIGN PATENT DOCUMENTS

| | | | |
|---|---|---|---|
| 59-128474 | 7/1984 | Japan | 368/76 |
| 339107 | 7/1959 | Switzerland | 368/229 |
| 752804 | 7/1956 | United Kingdom | 368/229 |

*Primary Examiner*—Vit W. Miska

*Attorney, Agent, or Firm*—Steinberg & Raskin

[57] ABSTRACT

A clock, preferably for wall-mounting, comprising a support for a substantially flat dial, to the rear side of which there is secured a known clock mechanism for indicating hours, minutes and seconds and for causing a swinging arm to oscillate, to said swinging arm there being removably connected a pendular member situated at least partly on the rear of the dial and connected through an aperture in the dial to an element positioned on the front of the dial.

13 Claims, 1 Drawing Sheet

CLOCK WITH PENDULAR ELEMENT

BACKGROUND OF THE INVENTION

This invention relates to a clock preferably for wall mounting. Various types of wall clocks of different sizes and methods of operation are already available. Such clocks are generally of a not inconsiderable weight, they can be too small to make reading of the time easy, and can be costly and sometimes noisy.

SUMMARY OF THE INVENTION

The main object of the present invention is to provide a wall clock which is light, easy to read, easy to assemble and has a cost which is accessible to most users.

These and further objects which will be more apparent to an expert of the art are attained by a clock comprising a support for a substantially flat dial, to the rear side of which there is secured a known clock mechanism for indicating hours, minutes and seconds and for causing a swinging arm to oscillate, to said swinging arm there being removably connected a pendular member situated at least partly on the rear of the dial and connected through an aperture in the dial to an element positioned on the front of the dial.

BRIEF DESCRIPTION OF THE DRAWINGS

The invention is illustrated by way of non-limiting example on the accompanying drawings in which.

DESCRIPTION OF A PREFERRED EMBODIMENT

Figure 1:
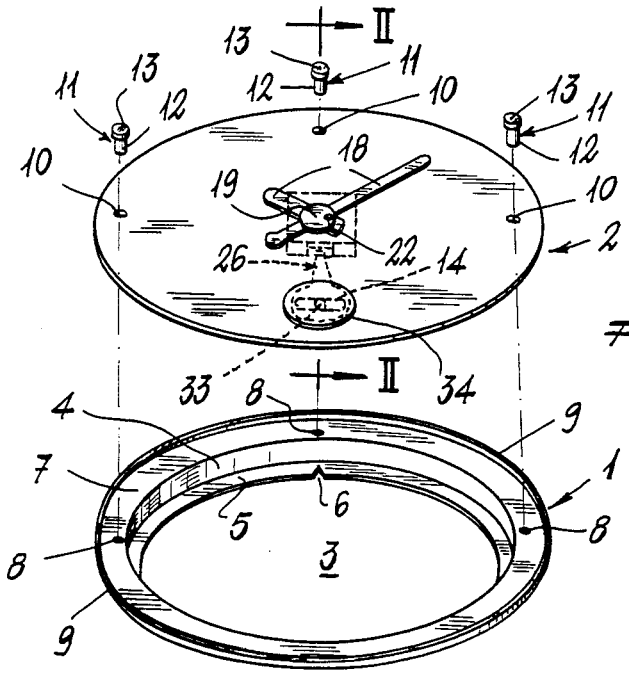
FIG. 1 is an exploded perspective view of a clock constructed in accordance with the present invention.
Figure 2:
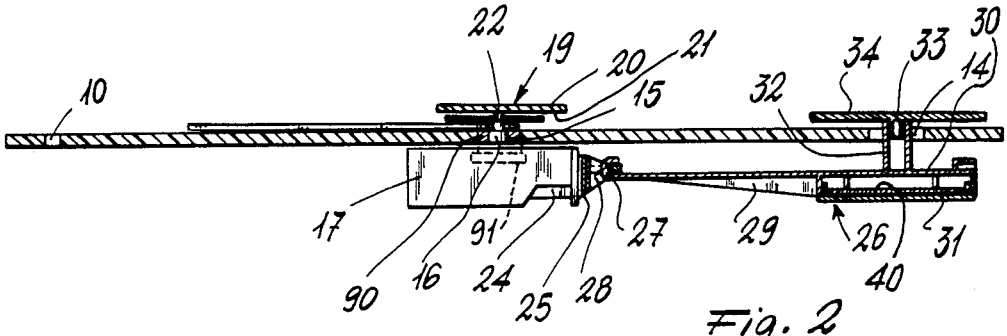
FIG. 2 is a section on the line II—II through a dial and through elements which characterise the present invention, the clock mechanism not however being shown sectioned.

With reference to the figures, the clock comprises a support 1 for a dial 2. Said support 1, which acts as a spacer for maintaining a distance from the wall to which the clock is fitted, comprises a circular hole 3 delimited by a wall 4 provided lowerly with a flange 5 extending towards the centre. Said flange advantageously comprises a recess 6 able to receive means (not shown on the figures) for securing the clock to the wall. Following the wall 4 there is a dial support flange 7 comprising holes 8 and terminating with a rim 9 rising vertically from said flange 7 in the direction away from the wall.

The substantially flat dial 2 comprises: holes 10 disposed in the twelve o'clock, three o'clock and nine o'clock position to receive as a light forced fit substantially cylindrical inserts 11 having a shank 12 and a head 13 of greater diameter than the shank 12; a slot 14 provided in the dial in the six o'clock position; and a central hole 15 through which the three conventional concentric shafts pass, here indicated overall by 16 and pertaining to a usual battery-operated clock mechanism. To said shafts 16 there are secured two hour and minute hands 18 and a symmetrical element 19 which in the described embodiment is circular with an upper surface 20 and a lower surface 21.

Projecting from its lower surface 21 the symmetrical element 19 comprises a hollow pin 22 which can be forced onto the most inner shaft (for seconds) of the shafts 16 of the clock mechanism 17, while on its upper surface 20 it comprises in a peripheral position a different-coloured indicator element 22 for example of circular shape. Said symmetrical element displays the passing of seconds by means of the indicator element 22.

The normal clock mechanism, specifically for pendulum clocks, comprises a swinging arm 24 operated by the clock mechanism 17 in the sense that this latter impresses oscillatory motion on it. At its free end 25 it comprises an eyelet 28 to which a pendular member 26 is connected. The connection is made by engaging a hook-shaped end 27 of said member 26 with said eyelet 28. The pendular member 26 comprises an arm 29 rigid with a box structure having two parts 30 and 31 which enclose a metal mass 40 and are joined together, one part, namely the part 30, being fixed to the arm 29 and positioned closer to the dial 2. Said part 30 comprises a hollow cylindrical projection 32 directed towards said dial. Said hollow cylindrical projection 32 traverses the slot 14 in the dial and receives as a forced fit a cylindrical pin 33 which projects perpendicularly towards the dial from a disc element 34 located on the outside of the dial. Said element 34 is preferably of the same shape as but larger than the symmetrical element 19.

A ring nut 90 screwed onto a bush 91 of the mechanism 17 secures this latter to the dial.

The assembly of the clock is very simple. The dial 2 is firstly placed on the support flange 7 of the support 1 taking care that the holes 8 in this latter mate with the holes 10 of the former. The shanks 12 of the inserts 11 are now inserted through the now superposed holes until their heads 13 rest against the dial 2. The support 1 and dial 2 are now fixed together.

At this point, the clock mechanism 17 is fixed to the rear of the dial 2 by passing the mechanism shafts 16 through the central hole 15 in the dial, fitting the hands 18 onto said shafts and mounting on the central shaft the hollow pin 22 rigid with the symmetrical element 19.

After this the pendular member 26 is connected to the swinging arm 24 and the hollow cylindrical projection 32 passed through the slot 14 so that it juts beyond the dial 2. The cylindrical member 33 of the element 34 is then inserted into the cavity of said projection 32. The element 34 will therfore swing by virtue of being moved by the swinging arm 24 connected to the clock mechanism. As can be seen, the assembly of the clock is simple. Said clock is also very light as its individual component parts with the exception of the internal members of the usual clock mechanism 17 are of plastics construction by moulding.

What I claim is:

1. A clock comprising a support for a substantially flat dial, a clock mechanism for indicating hours, minutes and seconds being secured to a rear side of said substantially flat dial, a swinging arm arranged to be actuated by said clock mechanism to oscillate, a pendular member removably connected to said swinging arm, and situated at least partially on the rear side of the dial, an aperture through said dial and an element positioned on a front side of the dial, said element being connected to said pendular member through said aperture in the dial, wherein the pendular member comprises an arm with a hook-shaped end for removably engaging an eyelet provided at a free end of the swinging arm which is driven by the clock mechanism.

2. A clock as claimed in claim 1, wherein a symmetrical element provided with an eccentric indicator and acting as a seconds display, is connected to the clock mechanism.

3. A clock as claimed in claim 2, wherein the element positioned on the front of the dial is the same shape as but larger than the symmetrical element.

4. A clock as claimed in claim 2, wherein all component parts of the clock with the exception of members of the clock mechanism are of plastics construction formed by moulding.

5. The clock of claim 1, arranged for wall-mounting.

6. A clock comprising a support for a substantially flat dial, a clock mechanism for indicating hours, minutes and seconds which is secured to a rear side of said substantially flat dial, a swinging arm arranged to be actuated by said clock mechanism to oscillate, a pendular member removably connected to said swinging arm, and situated at least partially on the rear side of the dial, an aperture through said dial and an element positioned on a front side of the dial, said element being connected to said pendular member through said aperture in the dial, wherein the dial comprises at least three holes disposed peripherally and arranged to cooperate with three holes provided in a resting flange for the dial on the support, said holes receiving separate, independent inserts for securing the dial to the support.

7. The clock of claim 6, wherein said holes are disposed approximately at twelve O'clock, three O'clock, and nine O'clock positions on the dial.

8. The clock of claim 6, arranged for wall-mounting.

9. A clock comprising a support for a substantially flat dial, a clock mechanism for indicating hours, minutes and seconds which is secured to a rear side of said dial, a swinging arm arranged to be actuated by said clock mechanism to oscillate, a pendular member removably connected to said swinging arm, and situated at least partially on the rear side of the dial, an aperture through the dial and an element positioned on a front side of the dial, with said element connected to said pendular member through said aperture in the dial, wherein the pendular member comprises a hollow cylindrical projection which traverses the aperture in the dial and is arranged to receive a cylindrical pin of the element.

10. The clock of claim 9, additionally comprising a symmetrical element provided with an eccentric indicator and acting as a seconds display, being connected to the clock mechanism.

11. The clock of claim 10, wherein the element positioned on the front of the dial is the same shape as but larger than the symmetrical element.

12. The clock of claim 10, wherein all component parts of the clock with the exception of members of the clock mechanism, are of plastics construction formed by moulding.

13. The clock of claim 9, arranged for wall-mounting.

* * * * *